US007686354B2

(12) United States Patent
Jasper

(10) Patent No.: US 7,686,354 B2
(45) Date of Patent: Mar. 30, 2010

(54) LOCK BOLT RELEASE SYSTEM AND METHOD

(75) Inventor: Thomas E. Jasper, Bryantsville, KY (US)

(73) Assignee: Lockmasters Security Institute, Inc., Nicholasville, KY (US)

( * ) Notice: Subject to any disclaimer, the term of this patent is extended or adjusted under 35 U.S.C. 154(b) by 0 days.

(21) Appl. No.: 11/388,082

(22) Filed: Mar. 23, 2006

(65) Prior Publication Data

US 2007/0222229 A1 Sep. 27, 2007

(51) Int. Cl.
*E05C 1/06* (2006.01)
*E05C 1/02* (2006.01)

(52) U.S. Cl. ..... 292/33; 292/137; 292/150; 292/DIG. 51

(58) Field of Classification Search ..... 70/92; 109/59 R, 59 T; 292/32–34, 37, 42, 137, 292/175, 171, 159, 169, 150, 145, DIG. 51, 292/38, 45, 49
See application file for complete search history.

(56) References Cited

U.S. PATENT DOCUMENTS 393,883 A * 12/1888 Brown, Jr. ..... 70/144
3,545,799 A * 12/1970 Gertsfeld ..... 292/34
4,836,707 A * 6/1989 Myers ..... 403/322.4
5,172,945 A * 12/1992 Doherty et al. ..... 292/49
5,915,766 A * 6/1999 Baumeister et al. .... 292/341.15
5,984,381 A * 11/1999 Yamagishi ..... 292/45
6,474,248 B1 * 11/2002 Stark et al. ..... 109/59 R
6,546,769 B2 4/2003 Miller et al.
6,622,534 B1 9/2003 Miller et al.

* cited by examiner

*Primary Examiner*—Carlos Lugo
*Assistant Examiner*—Alyson M Merlino
(74) *Attorney, Agent, or Firm*—Wood, Herron & Evans, L.L.P.

(57) ABSTRACT

A lock bolt release system operable with a door bolt supported by a door providing access to a secure area. A pawl is pivotally mounted on a distal end of a lock bolt, and the pawl is pivoted by operation of the door bolt prior to the lock bolt being movable by the door bolt. A wedge block is movably mounted on the lock bolt and is effective to block motion of the pawl and the door bolt. A stop member is located adjacent the wedge block and blocks motion of the wedge block, thereby preventing the door bolt from being disengaged from the structure. The stop member is movable, which permits the wedge block to be moved by the pawl and the door bolt to contact and move the lock bolt, thus, permitting the door bolt to be disengaged from the structure.

20 Claims, 7 Drawing Sheets

LOCK BOLT RELEASE SYSTEM AND METHOD

FIELD OF THE INVENTION

The present invention is directed generally to a lock bolt system and, more particularly, to a lock bolt system used on doors that are opened to provide access to secure areas.

BACKGROUND OF THE INVENTION

The use of lock bolts for security purposes is widespread to control access to items stored in lockable, high-security enclosures, such as vaults, safes, and cabinets. A door to the enclosure is often secured against opening by one or more extended door bolts. An internal lock bolt prohibits the door bolts from being retracted using an external handle. When using a combination type lock, entry of a proper combination permits the exterior handle to be used to release the lock bolt and retract door bolts, thereby unlocking the door and permitting it to be opened.

Often, the combination lock or other security lock is coupled by a spindle to a mechanism that retracts the lock bolt; and therefore, the spindle must be large enough to apply the necessary forces to retract the lock bolt. Further, the spindle generally requires a clearance opening that is about 0.625 inch in diameter. The presence of the clearance opening provides an ingress point into the lock case that may be used by an intruder to insert an instrument to image the lock components otherwise hidden inside the lock case. Therefore, there is a need to provide a lock bolt system that eliminates the clearance opening.

Conventional lock bolt systems may use a self-contained power supply inside the lock case to power an actuator that retracts the lock bolt. Non-ideal conditions or multiple closely-spaced entries may deplete the power supply such that the lock bolt cannot be retracted upon entry of a proper combination. Increasing the capacity of the power supply may minimize such occurrences; however, a larger power supply increases the size of the lock case as well as the cost of the lock. Thus, there is a need to improve the reliability of a power supply in a lock bolt system without increasing its size or cost.

Thus, there is a need for a lock bolt system that does not have the disadvantages of the known lock bolt systems discussed above.

SUMMARY OF THE INVENTION

The present invention provides a lock bolt release system that is simpler and more reliable than known systems. With the lock bolt release system of the present invention, the security lock and associated spindle are not used to apply forces required to move the lock bolt. Thus, there is substantially greater flexibility in choosing what kind of security lock to use. Further, security locks and associated spindles may be reduced in size; and clearance holes for spindles can be placed in more secure locations or, in some applications, eliminated, thereby improving system security. In addition, the security lock may be located remotely from the door. With smaller security locks, power supplies, if used, experience less of a load and are more reliable.

According to the principles of the present invention and in accordance with the described embodiments, the invention provides an apparatus for use with a door providing access to a secure area. A door bolt is movable with respect to the door, and the door bolt is engageable and disengageable with structure to respectively lock and unlock the door. The door supports a lock bolt that has a pawl pivotally mounted on a distal end. The pawl is pivotable by the door bolt. A wedge block is movably mounted on the lock bolt and is movable by the pawl from a first position blocking a pivoting of the pawl to a second position allowing the pawl to pivot. A stop member is located adjacent the wedge block and is movable between a first location and a second location. In the first location, the stop member blocks motion of the wedge block from the first position and thus, prevents the door bolt from being disengaged from the structure and maintains the door locked. At the second location, the stop member unblocks motion of the wedge block and thus, permits the door bolt to be disengaged from the structure and allows the door to be opened.

In one aspect of this invention, the stop member is moved from the first location to the second location in response to a security lock being successfully operated and thus, authorizing access to the secure area.

Many additional advantages and features of the invention will become more apparent upon review of the following detailed description taken in conjunction with the accompanying drawings.

DETAILED DESCRIPTION OF THE INVENTION

Figure 1:
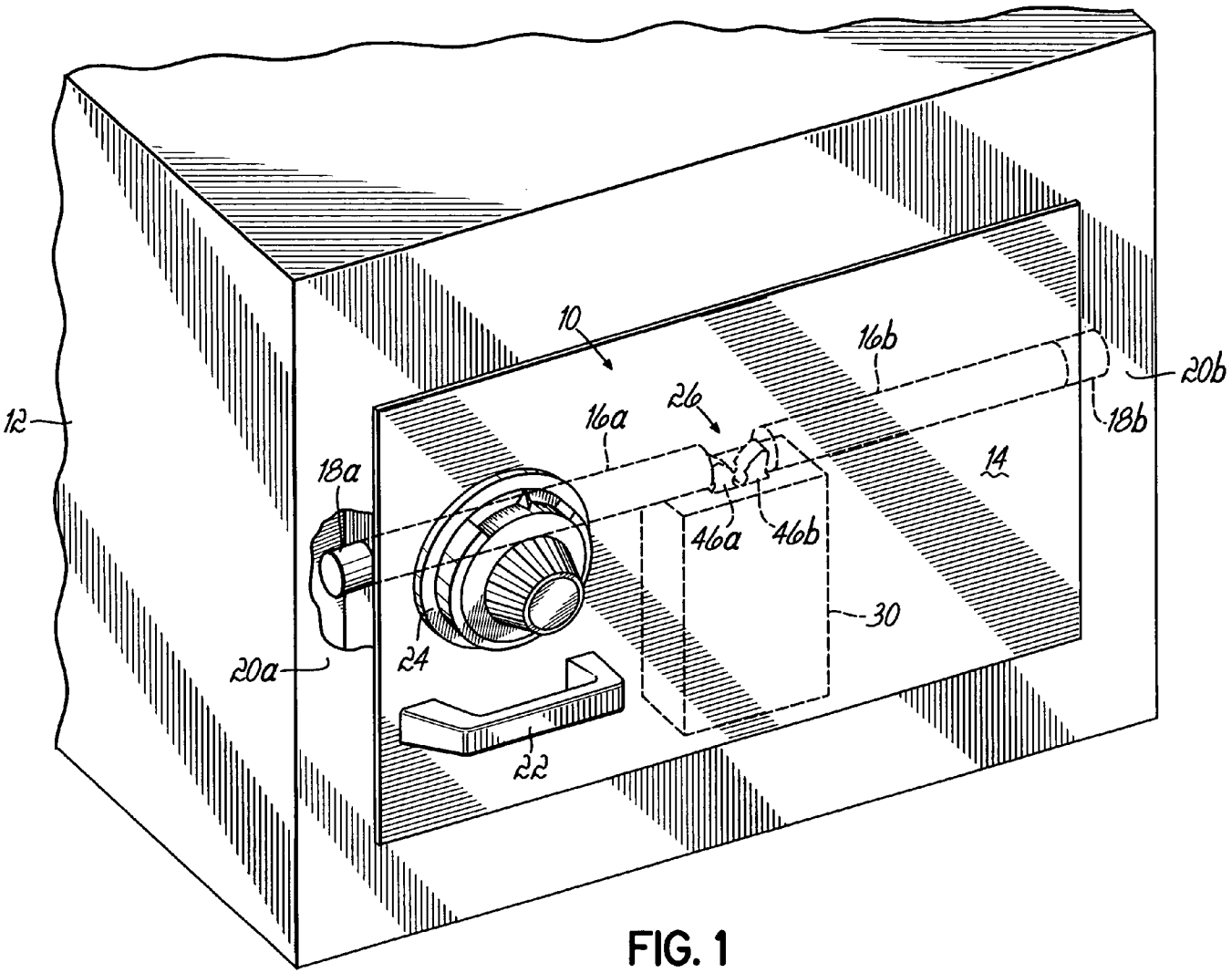
FIG. 1 is a partial perspective view of an exemplary embodiment of one application of an indirect bolt release system applied to a door lock in accordance with the principles of the present invention.

Referring to FIG. 1, in one exemplary application of a lock bolt system 10, a case 12, which represents a securable volume, is closed by a door 14 that may or may not be hinged to the case 12. The case 12 and door 14 are representative of a securable volume, for example, a lock box, a safe, a room, etc. Further, the case 12 and door 14 may be of any material, size and shape commensurate with the nature of the items to be secured and the level of security required by the application.

Door bolts 16*a*, 16*b* are mounted in the door 14 for respective longitudinal sliding motions or translations. Door bolt ends 18*a*, 18*b* slide into, or behind, respective structures 20*a*, 20*b* of the case 12, thereby prohibiting the door 14 from opening with respect to, or being removed from, the case 12. The door bolts 16*a*, 16*b* are operatively connected to a pivotable handle 22. Rotating the handle 22 in one direction, for example, a counterclockwise direction, is effective to translate the door bolts 16*a*, 16*b* away from each other and into the case 12, thereby locking the door 14 onto the case 12. Rotating the handle 22 in an opposite direction, for example, in a clockwise direction, is effective to move the door bolts 16*a*, 16*b* toward each other and out of the case 12, thereby unlocking the door 14 and permitting it to be moved with respect to the case 12. There are many known mechanical and/or electromechanical devices and mechanisms, for example, gears, cables, racks, solenoids, etc., that can be used to operatively connect the handle 22 to the door bolts 16*a*, 16*b*. Any known operative connection permitting the rotation of the handle to translate the door bolts 16*a*, 16*b* may be used. In addition, the handle 22 may alternately be implemented by a joy stick or other device for providing commands to move the door bolts and may be physically mounted on, or be located remote from, the door 14.

Also mounted on the door 14 is a known security lock 24. The security lock 24 may be one or more dials operating mechanically, may be electromechanical in nature, or may be operated at a location remote from the door 14. For purposes of this document, the security lock 24 represents any device operable by a user, which requires that the user demonstrate by successful operation of the device that the user is authorized to access the space behind the door 14. Successful operation of the security lock 24 may result in an electric signal, a mechanical movement, etc., any, or all of which, may be utilized by an indirect bolt release system 26 that is effective to inhibit or permit translations of the door bolts 16*a*, 16*b*.

Figure 2A:
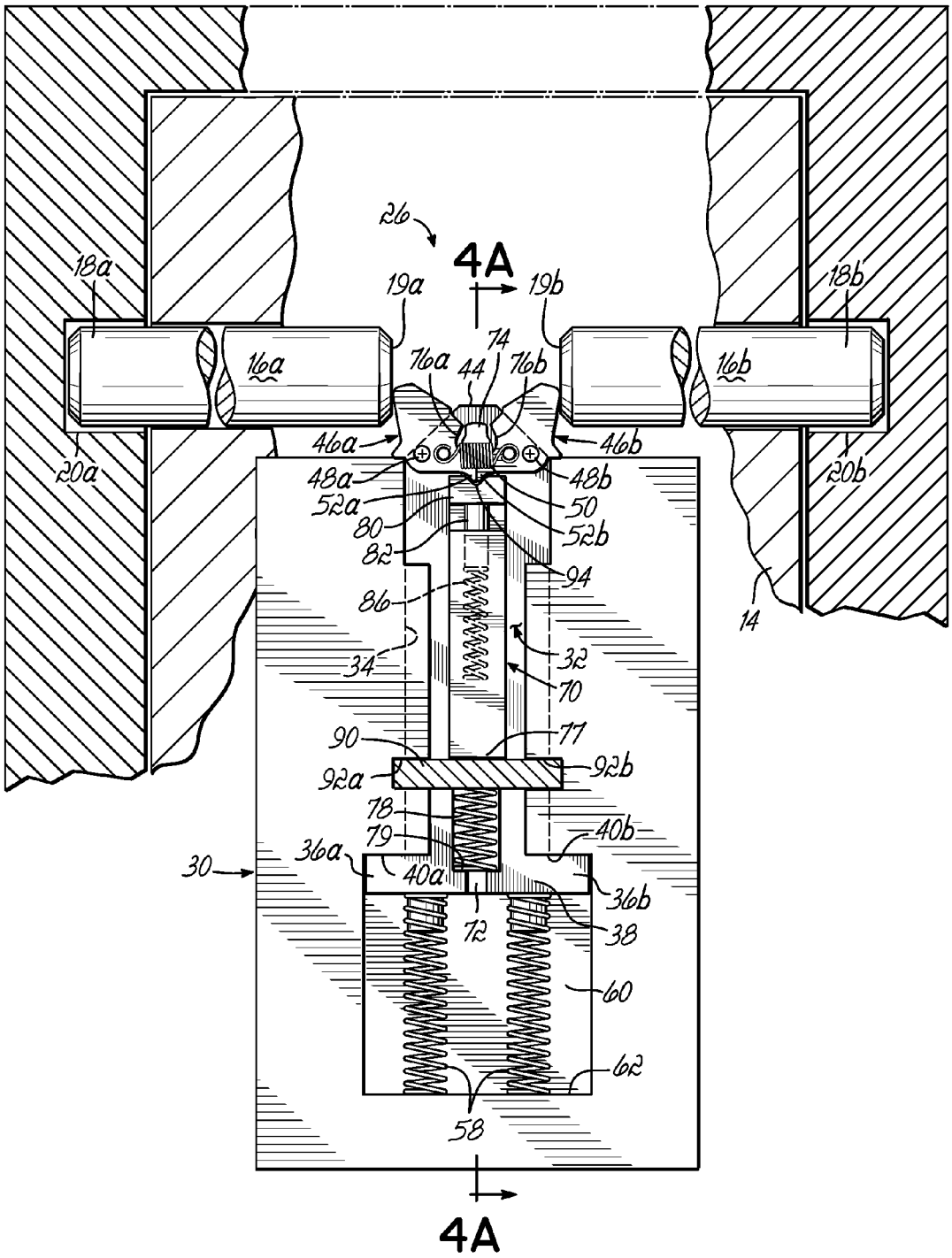
FIG. 2A is a rear elevation view of the indirect bolt release system of FIG. 1 with the door bolts in an extended position to lock the door.
Figure 3:
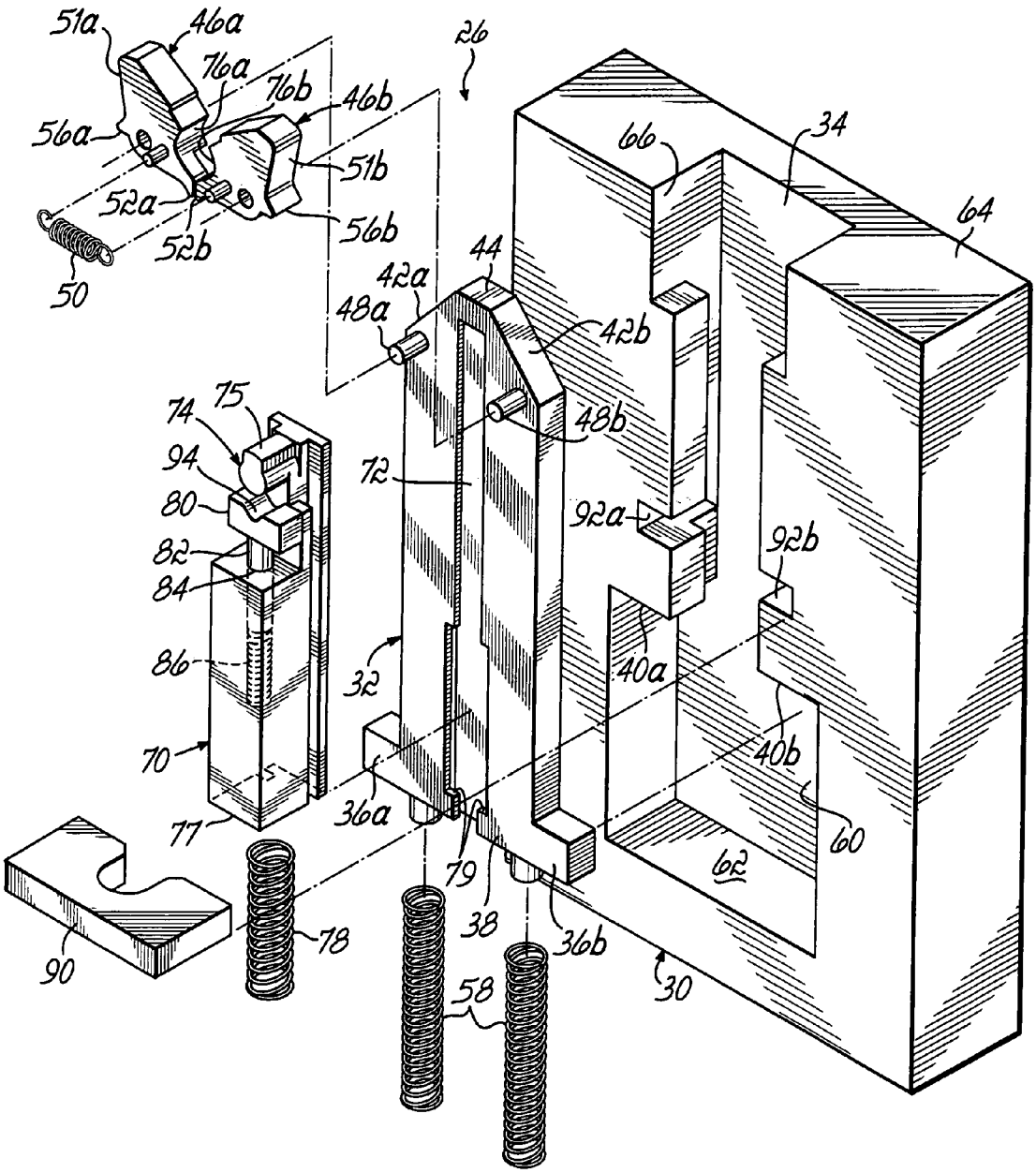
FIG. 3 is a disassembled perspective view of the indirect bolt release system of FIG. 1.

Referring to FIGS. 2A and 3, the indirect bolt release system 26 is contained within a lock body 30 that is attached to, or made integral with, the door 14. A lock bolt 32 is mounted for sliding motion within a slot 34 of the lock body 30. The lock bolt 32 has flanges 36*a*, 36*b* at a lock bolt proximal end 38, which contact projections 40*a*, 40*b* on the lock body 30. Thus, the flanges 36*a*, 36*b* limit a translation of the lock bolt 32 out of, or away from, a lock body surface 64. The lock bolt 32 has opposed angled cam surfaces 42*a*, 42*b* at its distal end 44. One or more biasing elements 58 are located in a cavity 60 of the lock body 30 and extend between the lock bolt proximal end 38 and an interior cavity surface 62. The lock bolt 32 is biased outward in a direction that extends away from a lock body surface 64, so that the angled cam surfaces 42*a*, 42*b* are positioned on paths traveled by the respective door bolts 16*a*, 16*b*.

A pair of pawls 46*a*, 46*b* are mounted on respective pivot pins 48*a*, 48*b* near the lock bolt distal end 44. A biasing element 50, for example, a compression spring, has its opposed ends connected to the pawls 46*a*, 46*b*. Thus, the pawls 46*a*, 46*b* are biased to pivot in opposite directions and generally away from each other. The pawls 46*a*, 46*b* have respective contact surfaces 51*a*, 51*b* that contact respective door bolt end surfaces 19*a*, 19*b*.

A wedge block carrier 70 is mounted for sliding motion within a slot 72 of the lock bolt 32. The lock bolt slot 72 and the lock body slot 34 are substantially parallel and therefore, the wedge block carrier 70 is translatable with respect to, and in a direction substantially parallel to, a translation of the lock bolt 32. The wedge block carrier 70 has a wedge block 74 that is sized and shaped to fit between opposed inner surfaces 76*a*, 76*b* of the respective pawls 46*a*, 46*b*. A biasing element 78, for example, a compression spring, is located in the lock bolt slot 72. The biasing element 78 extends between surfaces 79 of the lock bolt slot 72 and an end surface 77 of the wedge block carrier 70. Thus, the biasing element 78 biases the wedge block carrier 70 in an outward direction toward the pawls 46*a*, 46*b*.

A wedge block driver 80 has a guide rod 82 mounted for sliding motion inside a bore 84 of the wedge block carrier 70. The bore 84 is substantially parallel to the lock bolt slot 72; and therefore, the wedge block driver 80 is translatable in a direction substantially parallel to the translations of the wedge block carrier 70 and the lock bolt 32. A biasing element 86, for example, a compression spring, is located in the bore 84 below the guide rod 82 and thus, biases the wedge block driver 80 in an outward direction toward the wedge block 74.

The pawls 46*a*, 46*b* have respective drive tabs 52*a*, 52*b* that are located in a slot 94 at a distal end of the wedge block driver 80. The biasing element 78 biases the wedge block carrier 70 and the wedge block driver 80 toward the pawls 46*a*, 46*b*. The wedge block driver 80 pivots the pawls in opposite directions until the drive tabs 52*a*, 52*b* move into bearing contact with each other. Such contact blocks further pivoting of the pawls 46*a*, 46*b* and limits further motions of the wedge block driver 80 and wedge block carrier 70 by the biasing element 78.

To maintain the door bolts 16*a*, 16*b* extended and the door 14 locked, a movable obstruction or stop member 90 is located in opposed slots 92*a*, 92*b* of the lock body 30. The stop member 90 blocks a translation of the wedge block carrier 70 away from the pawls 46*a*, 46*b*, that is, downward as viewed in FIGS. 2A and 3. In a manner to be subsequently described, the security lock 24 (FIG. 1) is operatively coupled to the block member 90. Therefore, in response to a successful operation of the security lock 24 indicating that the user is authorized to remove the door 14 from the case 12, the stop member 90 is removed from its blocking relationship with the wedge block carrier 70. Thereafter, the stop member 90 is returned to its blocking relationship with the wedge block carrier 70. As noted earlier, successful operation of the security lock 24 may result in an electric signal, a mechanical movement, or other action, any, or all of which, may be utilized by the indirect bolt release system 26 to remove the stop member 90 in its blocking relationship with the wedge block carrier 70. Further, there are many known mechanical and/or electromechanical devices and mechanisms, for example, gears, cables, racks, solenoids, motors, or other devices, that can be used to operatively connect the security lock 24 with the stop member 90.

Figure 4A:
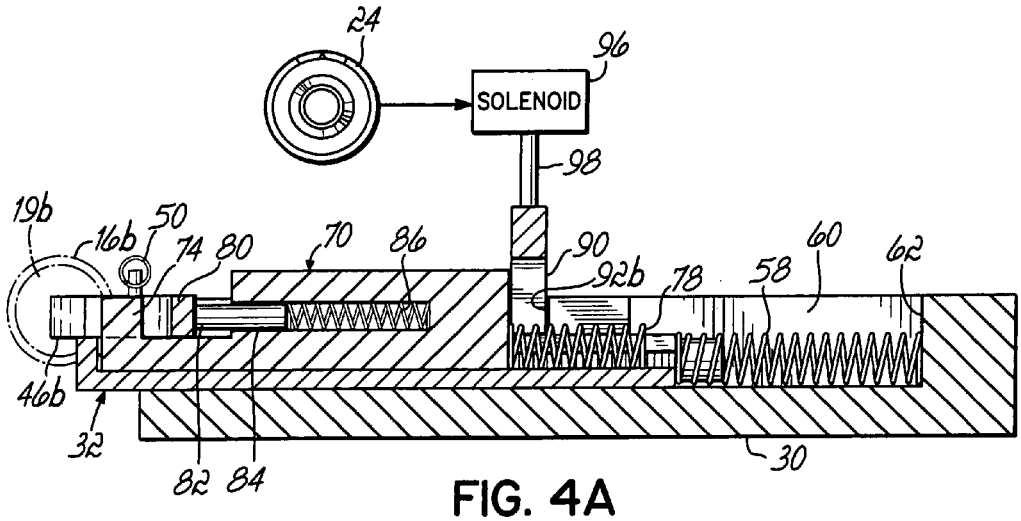
FIGS. 4A and 4B are cross-sectional side views taken along the line 4-4 of FIG. 2A and illustrate two operational states of the indirect bolt release system of FIG. 1.
Figure 4B:
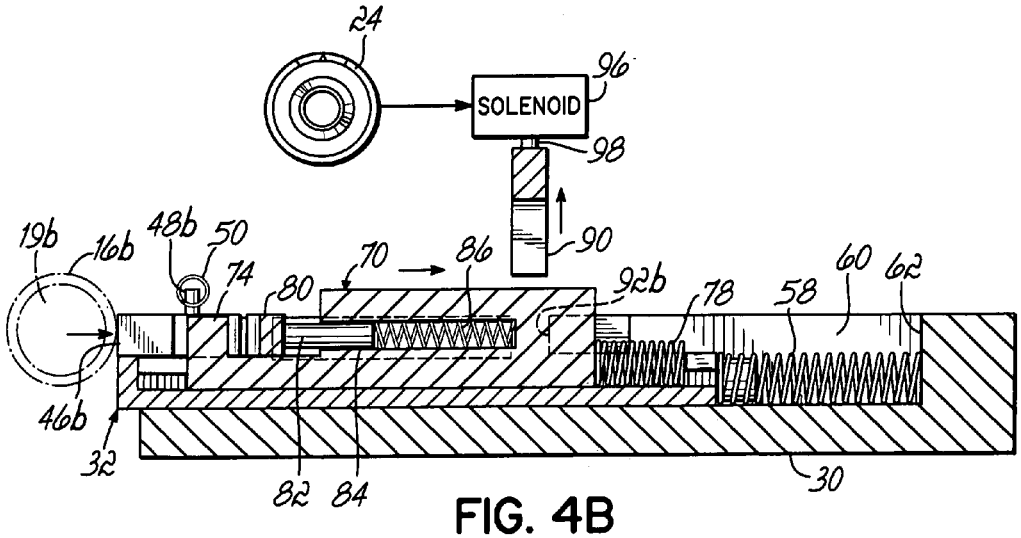

In one exemplary embodiment, referring to FIG. 4A, the security lock 24 is electrically connected to a solenoid 96 that, in turn, has an actuating rod 98 connected to the stop member 90. Upon the user successfully operating the security lock 24, the lock 24 provides an output signal to the solenoid 96 commanding a change of state of the solenoid 96. As shown in FIG. 4B, operation of the solenoid 96 retracts its actuating rod 98, thereby removing the stop member 90 from the slots 92*a*, 92*b* and unblocking motion of the wedge block carrier 70. In alternative embodiments, the security lock 24 may be located at locations remote from the location of the door 14.

Figure 2B:
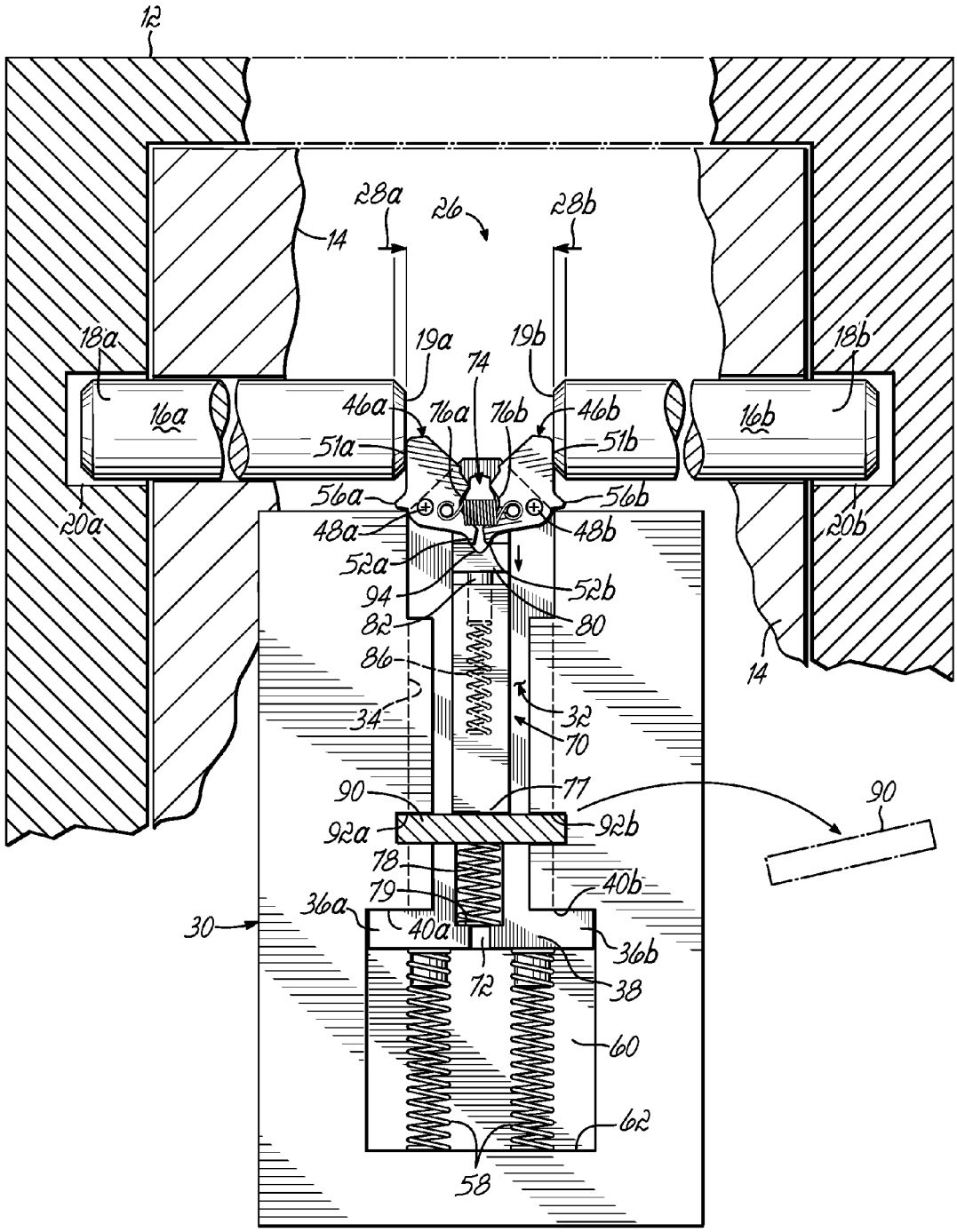
FIG. 2B is a rear elevation view of the indirect bolt release system of FIG. 1 in which the door bolts have been moved slightly to test the locked state of the door.

When the door 14 is locked and in the absence of the security lock 24 authorizing the door 14 to be opened, it is common for the handle 22 to be rotated to test whether the door 14 is locked or unlocked. A rotation of the handle 22 in a direction tending to unlock the door results in the door bolts 16*a*, 16*b* being translated toward each other. Door bolt end surfaces 19*a*, 19*b* engage and push against the respective contact surfaces 51*a*, 51*b* of the pawls 46*a*, 46*b*, and the pawls 46*a*, 46*b* pivot in opposite directions generally toward each other. Referring to FIG. 2B, with small translations 28*a*, 28*b* of the door bolts 16*a*, 16*b*, the pawls 46*a*, 46*b* pivot in opposite directions toward each other until respective opposed inner surfaces 76*a*, 76*b* contact the wedge block 74. During that small pivoting motion of the wedge blocks 46*a*, 46*b*, the respective drive tabs 52*a*, 52*b* experience a small pivoting motion in opposite directions away from each other and start to ride up opposing inner walls of the slot 94. That small pivoting action of the drive tabs 52*a*, 52*b* is effective to translate the wedge block driver 80 downward, as viewed in FIG. 2B, with respect to the wedge block carrier 70. At this point, the stop member 90 blocks any motion of the wedge block carrier. Thus, the wedge block 74 functions as a positive stop against further pivoting motion of the pawls 46*a*, 46*b* and further translation of the door bolts 16*a*, 16*b*. The wedge block 74 is a mechanical stop that is effective to oppose aggressive attempts to rotate the handle 22 without causing damage to the bolt release system 26 or the security lock 24.

Figure 2C:
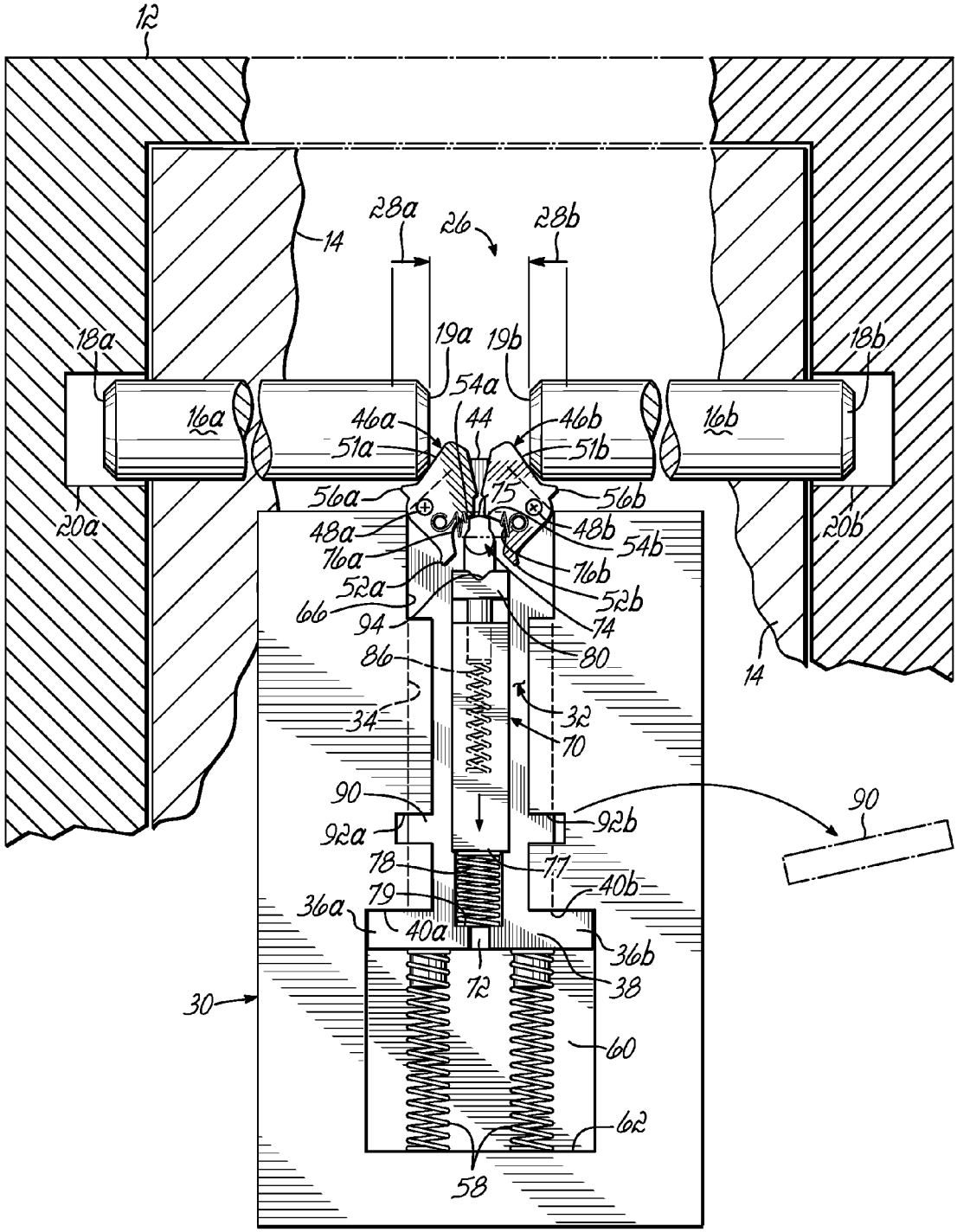
FIG. 2C is a rear elevation view of the indirect bolt release system of FIG. 1 in which authorization to unlock the door permits the door bolts to be moved further as part of a process of unlocking the door.

Upon a user successfully operating the security lock 24 demonstrating that the user is authorized to open the door 14, the solenoid 96 operates to remove the stop member 90 from the lock body slots 92*a*, 92*b*. Thereafter, rotation of the handle 22 causes the door bolts 16*a*, 16*b* to move in opposite directions toward each other, thereby pushing respective pawls 46*a*, 46*b* toward each other. As shown in FIG. 2C, pivoting of the pawls 46*a*, 46*b* toward each other causes drive tabs 52*a*, 52*b* to move in opposite directions away from each other and out of the slot 94 of the wedge block driver 80. Again, the pivoting of the drive tabs 52*a*, 52*b* applies a force against the wedge block driver 80 in a downward direction as viewed in FIG. 2C. In the absence of the stop member 90 from the slots 92*a*, 92*b*, the wedge block carrier 70 is able to move in opposition to the bias of the spring 78 in that downward direction. In this exemplary embodiment, the spring constants of the biasing element 78, 86 are chosen such that with the stop member 90 removed, the forces applied by the drive tabs 52*a*, 52*b* cause the biasing element 78 to compress before the biasing element 86, thereby moving the wedge block carrier 70 and wedge block driver 80 in unison in the downward direction away from the pawls 46*a*, 46*b*.

As the pawls 46*a*, 46*b* continue to be pivoted toward each other by the respective door bolts 16*a*, 16*b*, upper portions 54*a*, 54*b* of respective opposed pawl surfaces 76*a*, 76*b* contact an upper portion 75 of the wedge block 74. Thereafter, continued pivoting of the pawls 46*a*, 46*b* causes the surface portions 54*a*, 54*b* to push against the upper wedge portion 75, thereby continuing to move the wedge block carrier 70 downward away from the pawls 46*a*, 46*b* and further compressing the biasing element 78.

Further rotation of the handle 22 causes further translation of the door bolts 16*a*, 16*b* toward each other and corresponding further pivoting motions of the respective pawls 46*a*, 46*b*. During this continued pivoting of the pawls 46*a*, 46*b*, it should be noted that the pawls 46*a*, 46*b* have respective blocking tabs 56*a*, 56*b* that prevent the pawls from being moved into a slot 66 within the lock body 30. The pawls 46*a*, 46*b* continue their pivoting motion toward each other until the respective contact surfaces 51*a*, 51*b* become substantially parallel to, and coplanar with, the respective angled cam surfaces 42*a*, 42*b* of the lock bolt 32. Thereafter, continued inward translation of the door bolts 16*a*, 16*b* applies forces against the respective lock bolt angled cam surfaces 42*a*, 42*b*. The pivotal resiliency of the pawls 46*a*, 46*b* prevents them from bearing any substantial forces from the respective translating door bolts 16*a*, 16*b*.

Figure 2D:
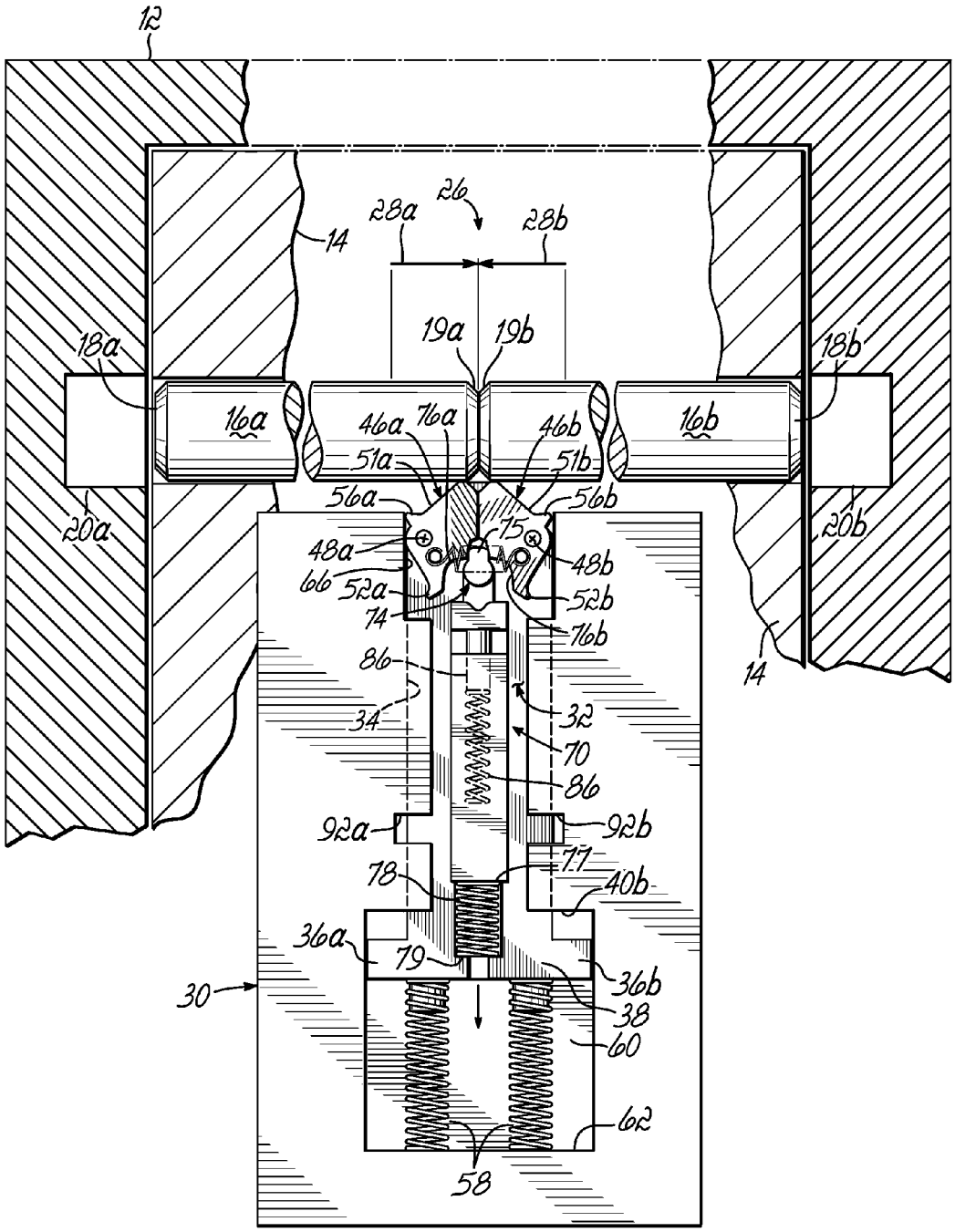
FIG. 2D is a rear elevation view of the indirect bolt release system of FIG. 1 in which the door bolts have released the door for opening.

Continued rotation of the handle 22 causes continued translation of the door bolts 16*a*, 16*b* toward each other, and the door bolt forces applied against the angled cam surfaces 42*a*, 42*b* pushes the lock bolt 32 downward through the lock body slot 34 and against the biasing forces of the springs 58. As shown in FIG. 2D, the inward translation of the lock door bolts 16*a*, 16*b* continues until their respective ends 18*a*, 18*b* are clear of the respective case structures 20*a*, 20*b*. At that point, the door 14 can be opened, thereby giving the user access to the secure area.

After the user finishes accessing the secured area, the handle 22 is turned in the opposite direction; and the door bolts 16*a*, 16*b* are translated in a direction away from each other to again extend the door bolt ends 18*a*, 18*b* into case structures 20*a*, 20*b*, thereby locking the door 14. Removing the door bolt end surfaces 19*a*, 19*b* from the respective lock bolt angled cam surfaces 42*a*, 42*b* allows the biasing element 58 to push the lock bolt 32 in an outward direction until the pawls 46*a*, 46*b* are again above the lock body surface 64 as shown in FIG. 2A. Substantially simultaneously, the biasing element 78 moves the wedge stop carrier 70 outward until the wedge stop upper portion 75 is driven into contact with, and pushes against, the pawl surfaces 54*a*, 54*b*. Continued motion of the wedge stop carrier 70 by the biasing element 78 causes the pawls 46*a*, 46*b* to pivot outward, thereby bringing the respective drive tabs 52*a*, 52*b* toward each other and into the slot 94 of the wedge block driver 80. At the end of its outward travel powered by the biasing element 78, the wedge block carrier 70 is clear of the slots 92*a*, 92*b*. The stop member 90 can be moved back into the slots 92, 92*b* by a return spring in solenoid 96, which biases the actuator shaft 98 outward. Alternatively, the solenoid 96 can be commanded to move the actuator shaft 98 outward to its original position, thereby pushing the stop member 90 into the slots 92*a*, 92*b* as shown in FIG. 4A.

The indirect bolt release system 26 illustrated in FIGS. 1-4 has numerous advantages over known devices. First, the indirect bolt release system 26 restrains and releases the door bolts 16*a*, 16*b* independent of an operative connection between the handle 22 and the door bolts 16*a*, 16*b*. Thus, relatively economical, simple and known mechanical and/or electromechanical systems operatively connecting the handle 22 and the door bolts 16*a*, 16*b* can be used without modification. Second, the security lock 24 is substantially mechanically uncoupled from the lock bolt 32 and the door bolts 16*a*, 16*b*. Thus, the less durable security lock 24 is not exposed to forces operating the door bolt and lock bolt; and a security lock that is less expensive, smaller and more secure may be used. Third, smaller electronic security locks can be remotely located from the door 14 and/or case 12. Fourth, the indirect bolt release system 26 permits the use of smaller power supplies and provides greater application flexibility. Fifth, the indirect bolt release system 26 is comparatively simple, has fewer parts but provides a highly reliable operation when compared to known systems. For example, use of the wedge block 74 provides a solid mechanical feedback to a user who is testing whether the door is locked or unlocked, while minimizing wear and tear on all components in the lock bolt system 10. Further, using the larger, more rigid cam surfaces 42*a*, 42*b* instead of the pawls 46*a*, 46*b* to react the major forces applied by the door bolt 16*a*, 16*b* in unlocking the door 14, reduces wear on the pawls 46*a*, 46*b* and the solenoid 96, thereby providing a longer, more reliable useful life of the lock bolt system.

While the invention has been illustrated by a description of embodiments and while those embodiments have been described in considerable detail, it is not intended that the appended claims be restricted or any way limited in scope to such detail. Additional advantages and modifications within the spirit and scope of the invention will readily appear to those skilled in the art. For example, in the illustrated and described embodiments, the indirect bolt release system 26 uses two door bolts 16*a*, 16*b*, two pawls 46*a*, 46*b* and two angled cam surfaces 42*a*, 42*b*. In an alternative embodiment, a single door bolt 16*a* may be used to operate a single pawl 46*a* as well as push against a single angled cam surface 42*a*.

The depiction in FIGS. 1-4 of the various components of the indirect bolt release system 26 is for only exemplary purposes. In any particular application, the size, shape, material and other physical characteristics of the components of the indirect bolt release system will be determined by application dependent specifications. In the exemplary examples illustrated herein the stop member 90 is illustrated as a relatively large component. In other examples, the stop member 90 may be a small portion of an end of a solenoid shaft and need only be sufficiently large to block a translation of the wedge block carrier 70.

Therefore, the invention in its broadest aspects is not limited to the specific details shown and described, and departures may be made from the details described herein without departing from the spirit and scope of the claims that follow.

What is claimed is:

1. An apparatus for use with a door providing access to a secure area, the door having a first door bolt movable with respect to the door, the first door bolt being engageable and disengageable with a structure to respectively lock and unlock the door, the apparatus comprising:

a lock bolt adapted to be supported by the door, the lock bolt comprising a proximal end, and a distal end adapted to be contacted by the first door bolt, the first door bolt being operable to move the lock bolt in a first direction;

a first pawl pivotally mounted on the distal end of the lock bolt, the first pawl adapted to be pivotable by the first door bolt prior to the lock bolt being movable by the first door bolt;

a wedge block movably mounted on the lock bolt, the wedge block being movable relative to the lock bolt by the first pawl from a first position blocking a pivoting of the first pawl to a second position allowing the first pawl to pivot; and a stop member located adjacent the wedge block and being movable between a first location blocking motion of the wedge block from the first position, thereby blocking pivotal movement of the first pawl and thus, adapted to prevent the first door bolt from being disengaged from the structure and maintaining the door locked, and a second location unblocking motion of the wedge block from the first position, thereby unblocking pivotal movement of the first pawl and thus, adapted to permit the first door bolt to be disengaged from the structure and the door to be opened.

2. The apparatus of claim 1 further comprising a lock body adapted to be connected to the door, the lock bolt being movably mounted in the lock body and thus, being movable with respect to the first door bolt.

3. The apparatus of claim 1 wherein the distal end of the lock bolt comprises an angled bearing surface adapted to contact the first door bolt, the bearing surface adapted to contact, and be movable by, the first door bolt in response to the first pawl being pivoted by the first door bolt.

4. The apparatus of claim 1 wherein the first direction is substantially perpendicular to a direction of motion of the first door bolt.

5. The apparatus of claim 1 wherein the wedge block further comprises a blocking member located adjacent the first pawl, the blocking member positively stopping a pivoting of the first pawl in response to the wedge block being in the first position.

6. The apparatus of claim 5 further comprising a wedge block driver movably mounted on the wedge block, the wedge block driver contacting the first pawl when the wedge block is in the first position.

7. The apparatus of claim 6 wherein with the stop member at the first location, pivoting motion of the first pawl moves the wedge block driver with respect to the wedge block.

8. The apparatus of claim 7 wherein with the stop member at the second location, the pivoting motion of the first pawl moves the wedge block driver and the wedge block together.

9. The apparatus of claim 6 further comprising a first biasing element contacting the proximal end of the lock bolt and adapted to move the lock bolt toward the first door bolt.

10. The apparatus of claim 9 further comprising a second biasing element contacting an end of the wedge block and adapted to move the wedge block toward the first door bolt, wherein with the stop member at the second location, the pivoting motion of the first pawl moves the wedge block away from the first door bolt in opposition to a biasing force of the second biasing element.

11. The apparatus of claim 10 further comprising a third biasing element contacting an end of the wedge block driver and adapted to move the wedge block driver toward the first door bolt, wherein with the stop member at the first location, the pivoting motion of the first pawl moves the wedge block driver away from the first door bolt in opposition to a biasing force of the third biasing element.

12. The apparatus of claim 10 wherein the pivoting motion of the first pawl moves the wedge block driver and the wedge block in the first direction substantially perpendicular to a direction of motion of the first door bolt.

13. The apparatus of claim 11 further comprising a fourth biasing element connected to the first pawl and applying a pawl biasing force.

14. The apparatus of claim 13 wherein the pawl biasing force is adapted to be applied in a direction opposing motion of the first door bolt in a direction tending to disengage the first door bolt from the structure.

15. The apparatus of claim 1 wherein the door further includes a second door bolt and the apparatus comprises:

a second pawl pivotally mounted to the distal end of the lock bolt, the first and second pawls adapted to be respectively pivoted by the first and second door bolts, and two angled bearing surfaces on the distal end of the lock bolt, the bearing surfaces respectively associated with the first and second pawls and adapted to respectively contact, and be respectively movable by, the first and second door bolts in response to the respective first and second pawls being pivoted by the respective first and second door bolts.

16. A method of using a lock bolt to permit operation of a door bolt movably mounted on a door, the door bolt being engageable and disengageable from a structure supporting the door to respectively permit and restrict access to a secure area, the method comprising:

moving a stop member to a first location that blocks motion of a wedge block movably mounted on the lock bolt;

engaging a pawl with the door bolt being moved in a first direction tending to disengage the door bolt from the structure, the pawl being rotatably mounted on the lock bolt;

engaging a wedge block driver with the pawl, the wedge block driver being movably mounted on, and moving with respect to, the wedge block;

preventing pivoting of the pawl with the wedge block to thereby limit motion of the door bolt in the first direction prior the door bolt disengaging from the structure and prior to the door bolt engaging the lock bolt and thus, maintaining the door locked and restricting access to the secure area;

moving the stop member to a second location that unblocks motion of the wedge block;

pivoting the pawl with the door bolt being moved in the first direction, the pawl moving the wedge block driver and the wedge block until the door bolt contacts the lock bolt; and moving the lock bolt, the wedge block and the wedge block driver in response to the door bolt contacting the lock bolt, motion of the lock bolt, wedge block and wedge block driver permitting the door bolt to be moved out of engagement with the structure, thereby unlocking the door and permitting access to the secure area.

17. The method of claim 16 further comprising moving the stop member to the second location in response to a security lock being successfully operated, thereby authorizing access to the restricted area.

18. The method of claim 17 further comprising thereafter automatically moving the stop member to the first location, thereby restricting access to the restricted area.

19. The method of claim 18 further comprising automatically returning the pawl, the wedge block driver, the wedge block and the lock bolt to starting positions in response to the door bolt being moved in a direction opposite the first direction.

20. A method of using a lock bolt to permit operation of a door bolt movably mounted on a door, thereby locking and unlocking the door to respectively grant and restrict access to a secure area behind the door, the door bolt being engageable and disengageable from a structure supporting the door, the method comprising:

moving a stop member to a first location blocking motion of a wedge block movably mounted on the lock bolt;

pivoting a pawl rotatably mounted on the lock bolt with the door bolt being moved away from the structure;

stopping the pivoting of the pawl with the wedge block, thereby limiting motion of the door bolt prior the door bolt disengaging the structure and thus, maintaining the door locked and restricting access to the secure area;

moving the stop member to a second location unblocking motion of the wedge block;

pivoting a pawl rotatably mounted on the lock bolt with the door bolt being moved away from the structure, the pawl moving the wedge block until the door bolt contacts the lock bolt; and moving the lock bolt with the door bolt until the door bolt is disengaged from the structure, thereby unlocking the door and permitting access to the secure area.

* * * * *